United States Patent [19]

Buck

[11] Patent Number: 4,532,781

[45] Date of Patent: Aug. 6, 1985

[54] KNITTING MACHINE

[75] Inventor: Alfred Buck, Bondorf, Fed. Rep. of Germany

[73] Assignee: Memminger GmbH, Freudenstadt, Fed. Rep. of Germany

[21] Appl. No.: 438,890

[22] PCT Filed: Mar. 2, 1982

[86] PCT No.: PCT/DE82/00039

§ 371 Date: Oct. 21, 1982

§ 102(e) Date: Oct. 21, 1982

[87] PCT Pub. No.: WO82/03096

PCT Pub. Date: Sep. 16, 1982

[30] Foreign Application Priority Data

Mar. 3, 1981 [DE] Fed. Rep. of Germany ..... 3108041

[51] Int. Cl.[3] ..... D04B 15/06; D04B 15/14

[52] U.S. Cl. ..... 66/104; 66/106; 66/115

[58] Field of Search ..... 66/8, 91, 104, 106, 66/109, 115

[56] References Cited

U.S. PATENT DOCUMENTS

| | | | |
|---|---|---|---|
| 492,539 | 2/1893 | Diebel | 66/106 |
| 575,012 | 1/1897 | Sturgess | 66/104 |
| 1,882,430 | 10/1932 | Lawson | 66/8 |
| 1,952,928 | 3/1934 | Lawson | 66/8 |
| 2,016,870 | 10/1935 | Meiwald | 66/9 A |
| 2,101,005 | 11/1937 | Lawson | 66/8 |
| 4,018,063 | 4/1977 | Buck | 66/104 X |

FOREIGN PATENT DOCUMENTS

| | | | |
|---|---|---|---|
| 342525 | 10/1918 | Fed. Rep. of Germany | 66/115 |
| 2025144 | 12/1970 | Fed. Rep. of Germany | 66/104 |
| 2047401 | 3/1972 | Fed. Rep. of Germany | 66/106 |
| 2430824 | 1/1976 | Fed. Rep. of Germany | 66/106 |
| 2460868 | 7/1976 | Fed. Rep. of Germany | 66/106 |
| 2642079 | 3/1978 | Fed. Rep. of Germany | 66/106 |
| 347574 | 1/1905 | France | 66/8 |
| 19814 | of 1893 | United Kingdom | 66/106 |
| 20835 | of 1894 | United Kingdom | 66/104 |

*Primary Examiner*—Wm. Carter Reynolds

*Attorney, Agent, or Firm*—Frishauf, Holtz, Goodman & Woodward

[57] ABSTRACT

In order to increase the operating speed of the knitting machine and to attain a fine needle cut, sinkers (7), with their shaft (12), are guided on a needle carrier (1), and simultaneously forming guide ribs for adjacent needle shafts (3). A projection cam (16) which imparts to the sinkers (7) the movement transverse to the needles (2) is disposed directly on the needle carrier (1).

19 Claims, 9 Drawing Figures

Figure 1:
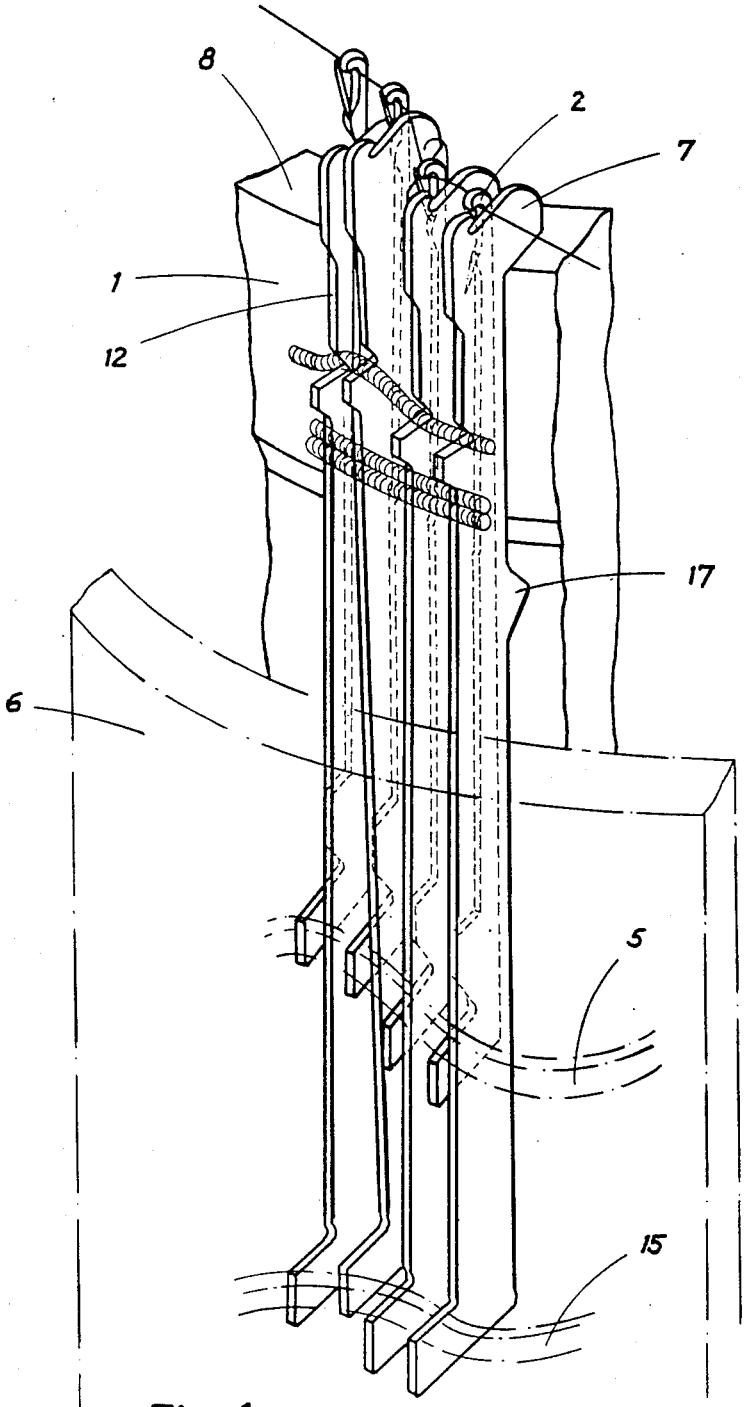

VII
VI
V
5
25
24
15

KNITTING MACHINE

The invention relates to a knitting machine having a needle carrier, which is equipped with needles that are displaceable in the longitudinal direction and controlled by a needle cam. Sinkers controlled by a sinker cam protrude between the needles, projecting beyond the rim of the needle carrier, each sinker having its own sinker shaft. The sinkers are supported such that they are movable both transversely with respect to the needles and in their longitudinal direction and are controlled such that at a given knitting position, after the loop has been closed, they are moved outward, counter to the drawing-off movement of the associated needles and transversely thereto, while after the casting off of the knit loop they are moved inward, counter to the needle projection movement and transversely thereto.

BACKGROUND

A circular knitting machine of this type is known from German Disclosure Document DE-OS No. 2 025 144. The sinkers of that machine are moved counter to the needle drawing-off movement after the closing of the loop, that is, during the actual process of forming the loops. Consequently the distance which the needles must travel during the drawing-off movement becomes correspondingly shorter, so that the needle cam can be less steep. This permits a substantial increase in the knitting speed without an associated excessive stress on the needles. The transverse movement of the sinkers with respect to the associated needles which occurs after the loop has been closed serves to guide the sinkers into the correct position for casting off. After the process of forming the loop has been completed, when a given needle is once again projected, the corresponding sinkers are again moved back into the initial position, counter to the projection movement of the needle; in this operation, the sinkers are first moved transversely relative to the needles, in order that with their throat and tip they will encompass the half-completed row of loops and prevent the knitted goods from being pulled along with the projection movement of the needles.

In this circular knitting machine, the sinkers, each having a sinker shaft, are supported together with their sinker shafts on a sinker cam, which is disposed outside a sinker ring screwed to the needle cylinder. The sinker ring is provided with a horizontal flange in which radial slits are formed; the individual sinkers are guided radially movably in these slits. The control of the radial movement, which is transverse to the needles, is effected by a specialized embodiment of the sinker cam, which simultaneously controls the projection of the sinkers. Associated with this sinker cam is a retraction control cam for the sinkers, which is disposed on a cup-shaped, stationary machine head protruding beyond the flange of the sinker ring.

The structure of this circular knitting machine is relatively complicated; among other factors, it requires that the needles inserted into the guide grooves of the needle cylinder be surrounded at the outside not only by the sinker ring but also by the sinker cam and the sinker shafts. Furthermore, the sinker control cam controls two movements and is therefore relatively complicated; on the other hand, a certain minimum value for the needle cut must at least be met, because otherwise it would no longer be possible to provide satisfactory support for the sinkers in the slits of the sinker ring flange.

THE INVENTION

The object of the invention in general is to create a knitting machine having sinkers that can be moved longitudinally and transversely to the needle movement which is simple and operationally reliable in its design and which permits the attainment of a very fine needle cut, while at the same time, it is capable of operating at high speed.

Briefly, the sinkers, with their shafts, are guided on the needle carrier. The sinker shafts simultaneously form quide ribs for the adjacent needle shafts. A projection cam which imparts to the sinkers the movement transverse to the needles is disposed directly on the needle carrier.

Because the sinker shafts directly form the guide ribs for the needle shafts, a very fine needle cut is attained, the minimum value of which is dictated solely by the thickness of the sinkers. At the same time, the needles and the sinkers are easily accessible once the cam has been removed in the conventional manner; in circular knitting machines, a sinker ring is eliminated entirely, so that the result is a very simple design which is easy to service. The disposition of the projection cam of the sinkers directly on the needle carrier simplifies the construction still further and makes it possible to dispense with complicated cam surfaces for this projection cam, which can then be manufactured easily.

In a preferred and particularly simple form of embodiment, the sinkers, each with a butt disposed on the sinker shaft, engage a sinker cam groove forming the sinker cam; the sinker cam groove is disposed following the needle carrier and thus controls the retraction and projection movement of the sinkers counter to the directions of needle movement.

The projection cam may have a cam surface disposed on the base of the needle carrier and extending along the needle carrier; it can be traced by a tip on the shaft of each sinker. The cam surface may then be an oblique face embodied directly on the needle carrier and widening toward the outside with respect to the rim of the needle carrier; this oblique face can be created very easily and with high precision on the needle carrier during manufacture.

It is possible in principle to support the needle shafts directly on the surface of the needle carrier between the sinker shafts. In order to improve the guidance of the needle shafts and to reduce wear, however, it is advantageous for the needle shafts to be radially supported on guide ribs inserted into the needle carrier, intermediate of the sinker shafts. The sinker shafts being guided laterally between the guide ribs. The guide ribs then have two functions: First, they effect the lateral guidance of the sinker shafts, and second, they form the running surfaces for the needle shafts.

It is efficacious for the sinker shafts to be embodied such that in the radial direction they protrude by a predetermined amount beyond the needle shafts, so that the needle shafts will be guided reliably over their entire radial extension. In order to assure a durable, reliable engagement of the sinkers with their projection cam, it is advantageous for the sinkers and/or their shafts to be pressed radially inward toward the needle carrier base by spring force in the vicinity of the projection cam. In order to prevent the needle heads from being carried along with the outward movement of the sinkers and the adjacent portion of the needle shaft from being lifted from the associated guide rib, the disposition may if required be such that the needle shafts, in the vicinity between the needle carrier rim and the projection cam, are also pressed radially inward toward the needle carrier base by spring force.

In the novel circular knitting machine, the sinker movement can be controlled such that for the needles, the resultant cam curve is made up of sinusoidal curve segments of continuous curvature and merging with one another without gradations; the stress on the needles is thereby reduced to a minimum, and shocks and vibrations are simultaneously kept distant from the needles. Similarly, the curve of the sinker cam may be made up of continuously curved segments merging with one another, so that in the sinker control as well, abrupt movements causing vibration and high forces of mass acceleration do not occur.

The knitting machine may be embodied with only a single row of needles in the needle carrier, that is, as a single-knit machine; however, the concept of the invention is inherently applicable to a double-knit machine as well. A machine of that kind is then embodied with a second row of needles disposed in a second needle carrier, and sinkers are again located between the needles of the second row, being embodied and controlled in a manner corresponding to the sinkers of the first needle carrier.

The knitting machine according to the invention may be either a flat or a circular knitting machine; in the first case, the needle carrier is a needle bed, while in the second case it is a needle cylinder or a dial. With the machine embodied as a single-bed flat knitting machine, the practical advantage is attained, among others, that it is possible to dispense with the take-down of the knitted goods and with weights, which are otherwise necessary each time a new piece of work is begun or in other words each time a piece of goods is drawn off. It is also conceivable, in a double-bed flat knitting machine, to embody one needle bed (for instance, the front one) in accordance with the invention and to equip it and operate it accordingly, in order to be able to knit single-faced goods on this machine as well without difficulty, without providing for take-down of the goods.

DRAWINGS

Figure 2:
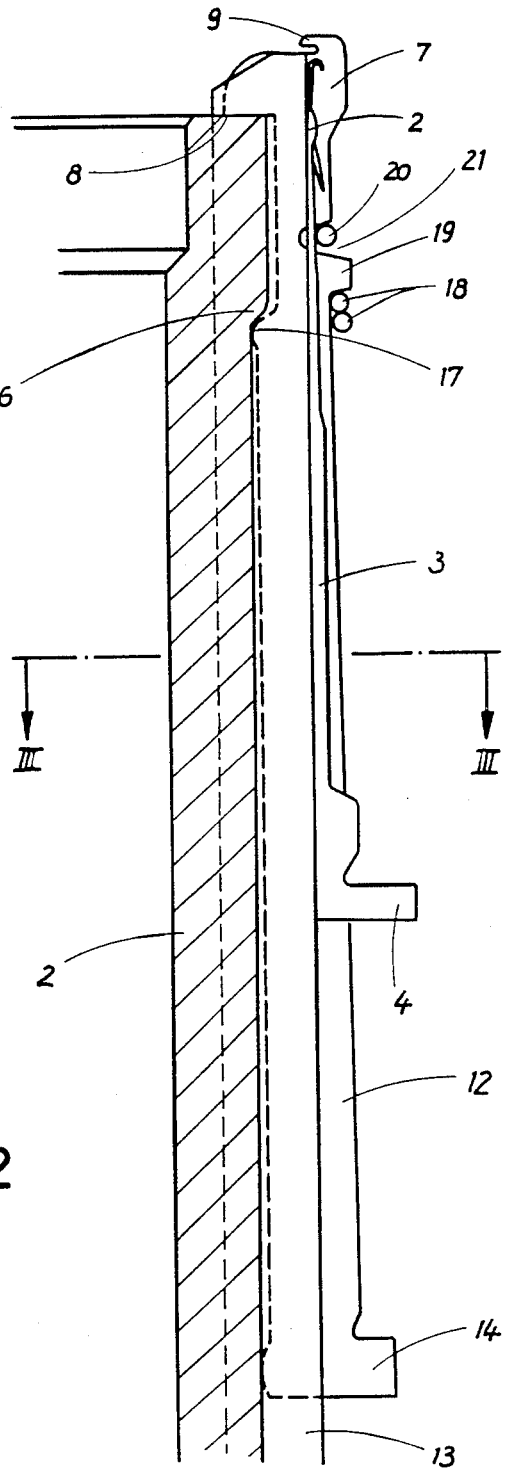
Figure 3:
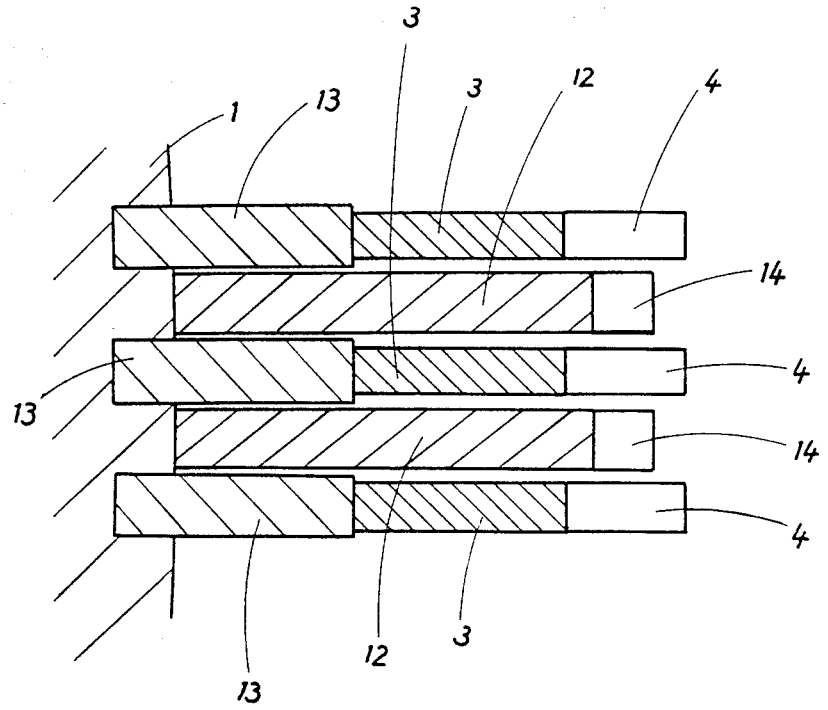
Figure 4:
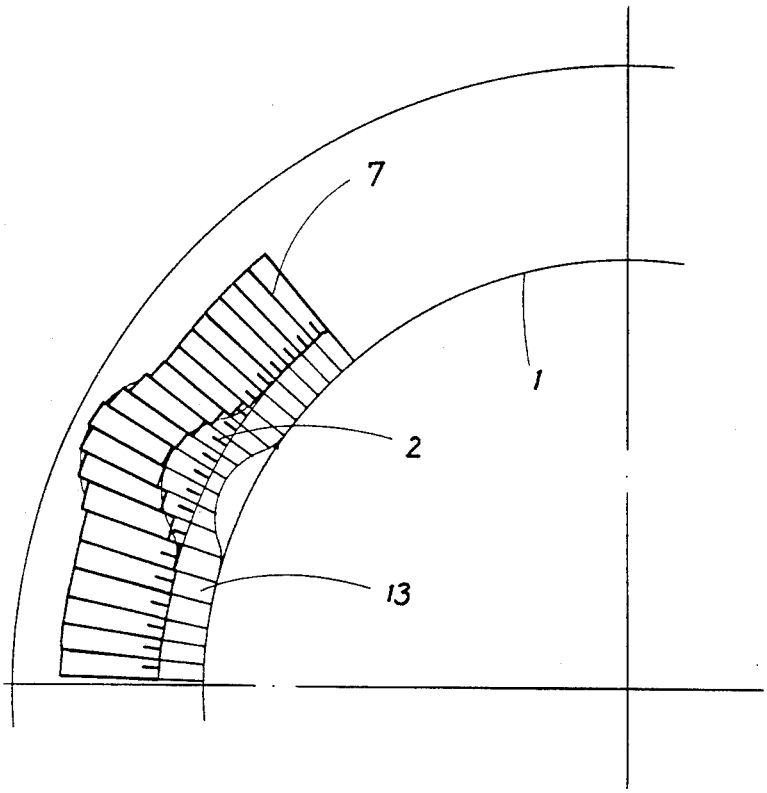
Figure 5:
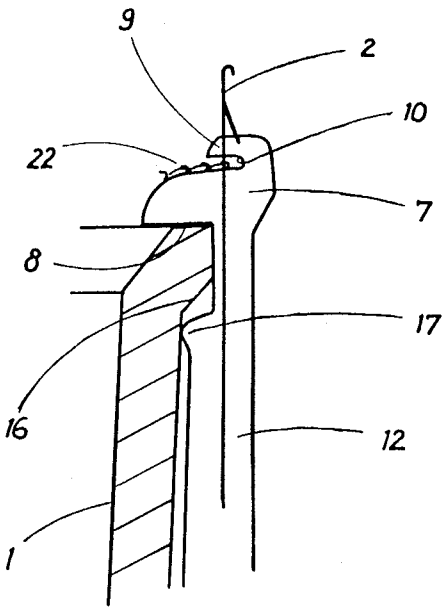
Figure 6:
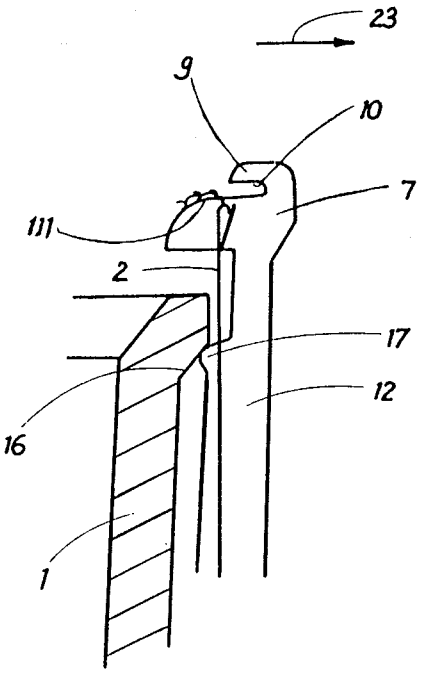
Figure 7:
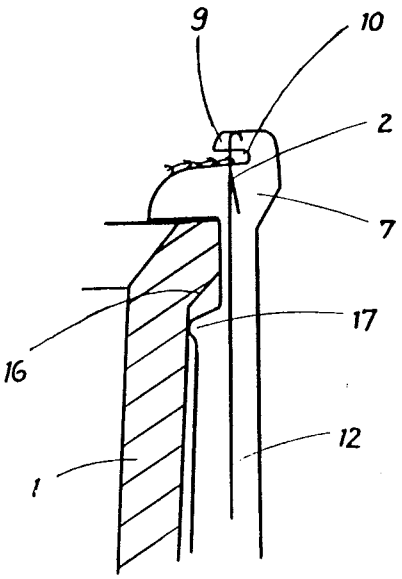
Figures 8, 9:
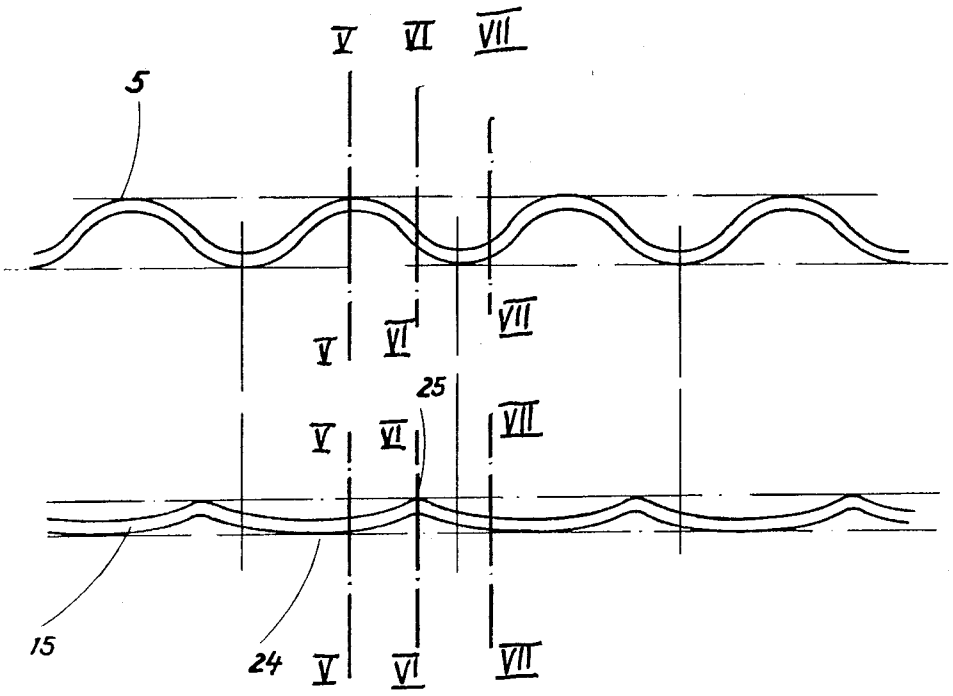

One exemplary embodiment of the subject of the invention is illustrated. Shown are:

FIG. 1, the needle cylinder of a circular knitting machine according to the invention having an associated cam cover, shown in a simplified schematic illustration in detail form;

FIG. 2, the needle cylinder of FIG. 1 in an axial section seen from the side and on a different scale, showing one needle and one sinker;

FIG. 3, the disposition of FIG. 2, cut along the line III—III of FIG. 2, seen in a side view and in detail form;

FIG. 4, the needle cylinder of FIG. 1 in a plan view, shown schematically and in detail;

FIGS. 5–7, the needle cylinder of FIG. 2, showing three different positions for the needle and the sinker, in a schematic illustration corresponding to FIG. 2 but in the form of a detail thereof;

FIG. 8, the sinker cam groove for the needle cylinder of FIG. 1, seen in a plan view; and FIG. 9, the needle cam groove for the needle cylinder of FIG. 1, seen in a plan view.

The needle cylinder 1 of a circular knitting machine, of which the other, known parts are not shown, is equipped at its circumference with latch needles 2, which extend parallel to one another and are supported such that they are longitudinally displaceable. The latch needles 2 have butts 4 on their needle shafts 3, and the butts 4 engage a needle cam groove 5, forming a needle cam curve, of a cam cover 6 surrounding the needle cylinder 1; however, the cam cover is not shown in detail. By means of drive elements which again are not shown, a relative movement between the cam cover 6 and the needle cylinder 1 is brought about, so that the needle cam groove 5 imparts to the latch needles 2 the projection and retraction movement required for the process of knitting.

One sinker 7 is disposed between each two latch needles 2, protruding beyond the needle cylinder rim 8 and having both a sinker tip 9 and a throat 10, as well as a looping edge 11. Each sinker 7 is provided with a sinker shaft 12, with which it is guided directly, located between the latch needles 2 adjacent to the shafts 3, on the needle cylinder 1. As is shown particularly clearly in FIG. 3, guide ribs 13 for this purpose are inserted radially into the needle cylinder 1, being made of a wear-resistant material which effects a good frictional pairing with the needle shafts 3 and the sinker shafts 12. The guide ribs 13 are disposed at the intervals of the needle cut and directly embody the radial support and the running surface of the needle shafts 3. At the same time, however, these guide ribs 13 effect the lateral guidance of the sinker shafts 12, which in this exemplary embodiment run directly on the base of the needle carrier, as shown on the cylinder; the sinker shafts in turn act directly as guide ribs for the needle shafts 3. Each sinker shaft 12 is provided with a butt 14, which protrudes into a sinker cam groove 15 embodied on the cam cover 6 and is controlled by this cam groove 15 in such a manner that a movement counter to the needle movement is imparted to the sinkers 7; this will be explained in further detail below.

A sinker projection cam is provided on the needle cylinder 1 in the vicinity of its rim 8, taking the form of an oblique face 16 formed by machining directly the needle cylinder 1 and becoming wider toward the outside relative to the needle cylinder rim 8. The respective sinkers 7 are supported on this oblique face 16 by means of a portrusion 17 molded onto their sinker shaft 12. The projection cam 16, as shown in FIGS. 5, 6, causes the sinkers to be moved radially outward, transversely relative to the longitudinal extent of the latch needles 2 when there is a projection movement of the sinker shafts 12 effected by the sinker shaft groove 15. In order to assure that the protrusions 17 will be held in durable engagement with the projection cam 16, the sinker shafts 12 in the vicinity of the projection cam 16 are under the influence of a spring force which is directed radially inward toward the base of the needle cylinder. This spring force is generated by two endless tension springs 18 running around the circumference; the springs 18 are supported laterally against protrusions 19 embodied on the sinker shaft 12. The sinker shafts 12 protrude by a predetermined amount in the radial direction beyond the needle shafts 3, as shown in FIG. 2, so that the needle shafts 3 are capable of executing their movement without hindrance from the springs 18. In order to prevent the needle shafts 3 from being carried along with the radial, outward movement of the sinkers 7 in the vicinity of the heads of the needles, the needle shafts 3 are pressed radially against the guide ribs 13 in the area between the projection cam 16 and the needle cylinder rim 8 by a spring force exerted by a spring 20 around the circumference. The sinker shafts 12 are embodied with a groove 21 open toward its rim; this groove 21 assures that the radial mobility of the sinkers 7 will not be hindered by the spring 20.

The circular knitting machine described thus far operates as follows, referring to FIGS. 5-7:

In the loop closing position (FIGS. 8, 9) shown in FIG. 5, the latch needle 2 has been projected to its farthest extent past the needle cylinder rim 8 by the needle cam groove 5. The adjacent sinker 7 is resting on the needle cylinder 8, protruding beyond it, and with its tip 9 and throat 10 it still encompasses the half-completed course of loops of the knitted goods indicated at 22.

After the yarn has been inserted, the latch needle 2 moves downward, controlled by the needle cam groove 5, while the sinker 7, controlled by the sinker cam groove 15, executes a contrary movement, that is, it is projected. The protrusion 17 thereby strikes against the oblique face of the projection cam 16, whereupon the sinker 7 is moved radially outward as indicated by the arrow; in other words, it is moved transversely to the needles 2. This tranverse movement has the effect that the knitted goods 111 are released by the tip 9 and throat 10 of the sinker 7 (release position). This radial movement of the individual sinkers 7 located one beside the other is shown for one knitting location in FIG. 4.

After casting off, a certain relaxation of the loop which has just been formed takes place, as a comparison of the needle cam curve 5 with the sinker cam curve 15 in FIGS. 8, 9 will show. This relaxation is the product of the relative offset between the two cam curves 5, 15. The latch needle 2 is then controlled such that it once again projects, while the adjacent sinker 7 executes a contrary drawing-off movement, in the course of which its protrusion 17 again slides radially inward along the oblique face of the projection cam 16 under the influence of the springs 18. The tip 9 and the throat 10 thereby encompass the knitted goods 22 once again and prevent them from being lifted by the latch needle 2 as it executes its projection movement see position VII, FIGS. 8, 9.

Once the needle has again attained the position shown in FIG. 5, the process described above is repeated.

From FIG. 9, it can be seen that the needle cam curve is made up of continuously curved, sinusoidal curve segments merging into one another without gradations; it is thereby assured that abrupt shocks and vibrations are not imparted to the latch needles 2. FIG. 8 similarly shows that the sinker cam curve is also made up of contiguous, continuously curved segments 24, which are connected to one another at 25 by curve segments having a smaller radius of curvature. The sinkers 7 therefore also experience a relatively gentle, jerk-free movement. Taken together, the sinkers and the needle cam curve result in very high knitting machine operating speed, while the stress on the needles and sinkers is low.

The exemplary embodiment described is a single-knit machine, which is equipped with latch needles 2 and sinkers 7 only in the needle cylinder 1. In principle it is possible to construct a double-knit machine according to the same principle. In such a machine, only one dial is then additionally present, which carries the second row of needles; Sinkers 7 embodied as before are then disposed between the individual needles of this second needle row. The sinkers 7 are controlled in their projection movement by a sinker cam groove provided in the dial cam, and a projection cam disposed on the dial is associated with the sinkers 7 in a manner corresponding to the projection cam 16; by this means, the sinkers 7 are moved with their protrusions 17 transversely to the needles in the described manner.

In a manner which is similar in principle to what has been described above in terms of a circular knitting machine, the invention can also be realized in the form of a flat-bed knitting machine of either the single- or double-bed type. In that case, the corresponding needle bed acts as the needle carrier instead of the needle cylinder as before.

The sinkers 7 are embodied as loop drawing and closing sinkers various loop lengths are then attainable by the use of various loop drawing and closing sinkers embodied for given, special loop lengths.

It is furthermore conceivable to associate a patterning apparatus with a novel knitting machine of the type described above, so as to be able to produce knitted goods which have a Jacquard or small-figured pattern.

I claim:

1. A knitting machine having at least one needle carrier (1) formed with a bearing surface portion, needles (2) with elongated shafts located on the carrier guided parallel to one another for longitudinally displaceable movement, a needle cam curve (5) controlling longitudinal displacement of the needles;

sinkers (7) each having a throat, a looping edge, and an elongated, flat shaft (12) located on the carrier (1);

a sinker cam curve (15) controlling longitudinal displacement of the sinkers (7), said sinkers protruding between the needles and beyond the needle carrier;

means (18) for supporting each sinker on the carrier for movement of said throat, looping edge, and shaft both transversely relative to the needles and in the longitudinal direction, said sinker cam curve (15) controlling the sinkers such that at a given knitting location, after the closing of a knitting loop, they are moved contrary to the drawing-off movement of the associated needles and transversely thereto toward the outside away from the shank of the needle and, after the casting off of the loop, they are moved inward toward the shank of the needle and further contrary to the needle projection movement and transversely thereto, characterized in that the sinker shafts (12) are supported and guided on the bearing surface portion of the needle carrier (1) and form lateral guide ribs for the needle shafts (3) of adjacent needles (2) , said sinker shafts (12) are of a length at least similar to the length of the needles to provide lateral support for the needles essentially throughout their lengths;

and wherein the needle cam curve (5) is located intermediate the length of the sinker shafts (12).

2. A knitting machine as defined by claim 1, characterized in that the sinkers (7), each with a butt (14) disposed on the sinker shaft (12), each engage a sinker cam groove (15) forming the sinker cam curve, this groove (15) being offset, in trailing direction, with respect to the needle cam curve.

3. A knitting machine as defined by claim 1, characterized by a projection cam having a cam surface (16) extending along the needle carrier and disposed on the needle carrier base, the cam surface (16) being capable of being followed by a protrusion (17) disposed on the shaft (12) of each sinker (7).

4. A knitting machine as defined by claim 3, characterised in that the cam surface is an oblique face (16) located directly on the needle carrier (1) in the vicinity of its rim (8), said surface (16) projecting toward the outside with respect to the needle carrier rim (8).

5. A knitting machine as defined by claim 1 further including guide ribs (13) located on the needle carrier positioned (1) for radially supporting the needles;

the sinker shafts (12) being located and laterally guided between the guide ribs.

6. A knitting machine as defined by claim 5, wherein the machine is a circular knitting machine, characterized in that the sinker shafts (12), in radial direction, protrude beyond the needle shafts (3) by a predetermined amount.

7. A knitting machine as defined in claim 3 wherein the support means include spring force means (18) pressing the sinkers (7) radially toward the needle carrier (1) in the vicinity of the projection cam (16).

8. A knitting machine as defined in claim 3 including further spring force means (20) acting on the needle shafts (2) in the region between the needle carrier rim (8) and the projection cam (16), are pressing the needle shafts radially against the needle carrier by spring force.

9. A knitting machine as defined in claim 1, characterized in that the needle cam curve (FIG. 9) comprises continuously curved, sinusoidal curved segments merging into one another without gradations.

10. A knitting machine as defined by in claim 1, characterized in that the sinker cam curve (FIG. 8) comprises contiguous, continuously curved segments (24).

11. A knitting machine as defined in claim 1, wherein the needle carrier forms a cylinder.

12. A knitting machine as defined in claim 1 further including a projection cam (16) imparting to the sinkers (7) said movement transverse to the needles (2), said projection cam being disposed directly on the needle carrier (1).

13. A knitting machine as defined in claim 12 further comprising a protrusion (17) disposed on a shaft (12) of each sinker (7) and engageable with said projection cam (16) for imparting to the sinkers said transverse movement to the needles upon movement of the sinkers in a projecting direction by the sinker cam curve (15).

14. A knitting machine as defined in claim 5 further including a projection cam (16) imparting to the sinkers (7) said movement transverse to the needles (2), said projection cam being disposed directly on the needle carrier (1).

15. A knitting machine as defined in claim 14 including further spring force means (20) acting on the needle shafts (2), in the region between a rim (8) of the needle carrier and the projection cam (16), and pressing the needle shafts against the needle carrier by spring force.

16. A knitting machine as defined in claim 5 wherein the support means includes spring force means (18) pressing the sinkers (7) toward the needle carrier (1).

17. A knitting machine as defined in claim 16 characterized by a projection cam having a cam surface (16) extending along the needle carrier and disposed on the needle carrier, the cam surface (16) being capable of being followed by a protrusion (17) disposed on the shaft (12) of each sinker (7).

18. A knitting machine as defined in claim 17 including further spring force means (20) acting on the needle shafts (2), in the region between a rim (8) of the needle carrier and the projection cam (16), and pressing the needle shafts against the needle carrier by spring force.

19. A knitting machine as defined in claim 1, wherein the sinker shafts (12) are longer than the needle shafts and guide the needle shafts throughout their entire length.

* * * * *

UNITED STATES PATENT AND TRADEMARK OFFICE

CERTIFICATE OF CORRECTION

PATENT NO. : 4,532,781

DATED : Aug. 6, 1985

INVENTOR(S) : Alfred BUCK

It is certified that error appears in the above-identified patent and that said Letters Patent is hereby corrected as shown below:

Column 7,lines 17, 18 (claim 5 lines 3 and 4) change "carrier positioned (1) to -- carrier 1 positioned --

Column 7, line 32 (claim 8, line 4) change "are" to -- and --

Signed and Sealed this

*Twenty-fifth* Day of *February 1986*

[SEAL]

*Attest:*

DONALD J. QUIGG

*Attesting Officer*

*Commissioner of Patents and Trademarks*